US005934945A

United States Patent [19]

Petersen et al.

[11] Patent Number: 5,934,945

[45] Date of Patent: Aug. 10, 1999

[54] CONTACT RETAINER FOR RETAINING A CONTACT TO A HOUSING

[75] Inventors: Carl C. Petersen, Mentor, Ohio; Richard P. Stelling, Fairfield, Conn.

[73] Assignee: Framatome Connectors USA Inc., Fairfield, Conn.

[21] Appl. No.: 08/811,679

[22] Filed: Mar. 5, 1997

[51] Int. Cl.[6] ..... H01R 13/426

[52] U.S. Cl. ..... 439/744

[58] Field of Search ..... 439/744, 745, 439/871

[56] References Cited

U.S. PATENT DOCUMENTS

| | | | |
|---|---|---|---|
| 3,229,244 | 1/1966 | Bachman | 439/744 |
| 3,390,376 | 6/1968 | Nava | 439/871 |
| 3,475,720 | 10/1969 | Culver | 439/744 |
| 4,701,004 | 10/1987 | Yohn | 439/871 |
| 5,324,215 | 6/1994 | Walkup et al. | 439/857 |
| 5,380,226 | 1/1995 | Anderson | 439/724 |
| 5,653,612 | 8/1997 | Petersen et al. | 439/871 |

FOREIGN PATENT DOCUMENTS

| | | | |
|---|---|---|---|
| 2338587 | 8/1977 | France | 439/744 |
| 1515831 | 8/1977 | Germany | 439/744 |
| 3413115 | 10/1985 | Germany | 439/744 |
| 0272127 | 8/1964 | Netherlands | 439/744 |
| WO 90/07807 | 7/1990 | WIPO . | |

*Primary Examiner*—Gary Paumen
*Assistant Examiner*—Tho D. Ta
*Attorney, Agent, or Firm*—Perman & Green, LLP

[57] ABSTRACT

A contact retainer for retaining a contact to a housing. The contact retainer has stop surfaces for cooperating with stop surfaces on the housing and on the contact to hold the contact to the housing. One of the stop surfaces on the contact retainer comprises a hook shaped flange having a free edge. The press edge of the flange faces an end of the contact retainer.

9 Claims, 2 Drawing Sheets

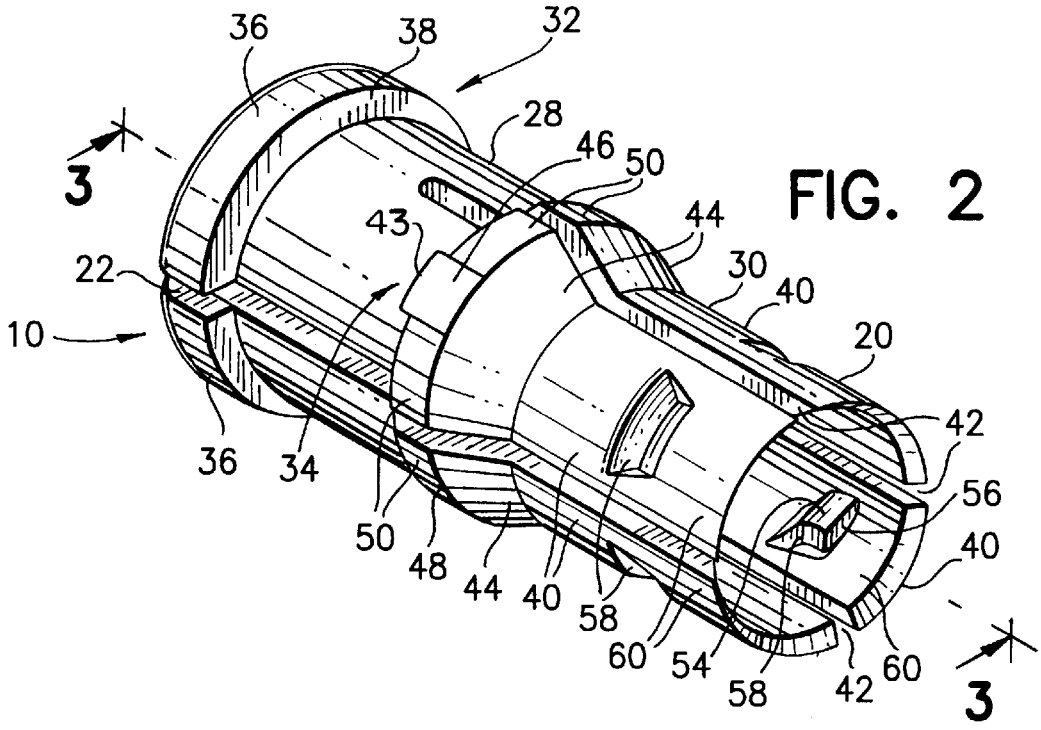
FIG. 2
FIG. 3
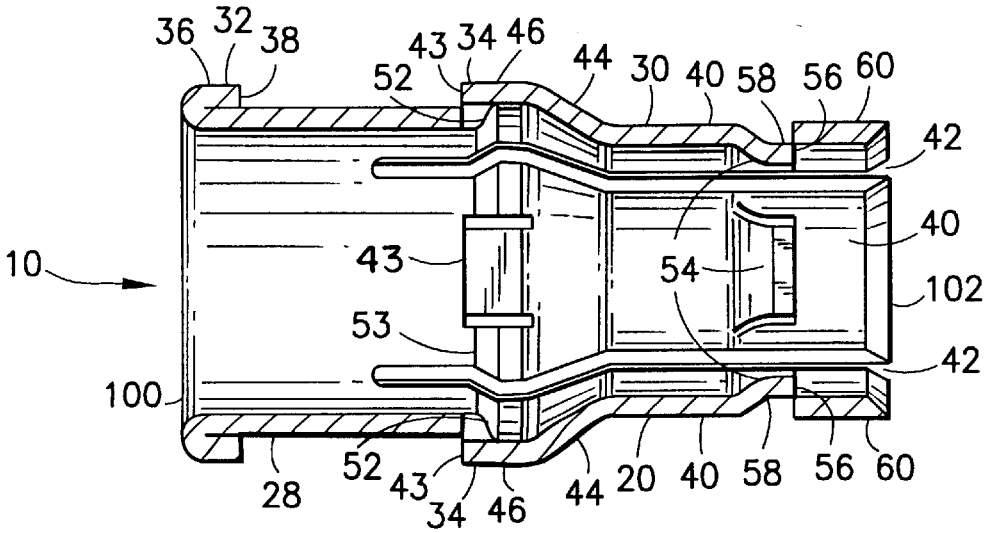

CONTACT RETAINER FOR RETAINING A CONTACT TO A HOUSING

BACKGROUND OF THE INVENTION

1. Field of the Invention

This invention relates to contact retainers for retaining electrical contacts to corresponding housings, and more particularly, to a contact retainer having a hook shaped stop.

2. Prior Art

U.S. Pat. No. 4,701,004 discloses a retention clip having pairs of locking lances to retain the clip to an annulus within a housing passageway. The retention clip also has lance like projections extending forward and inward to engage stop surfaces of a terminal inserted thereinto.

SUMMARY OF THE INVENTION

In accordance with one embodiment of the present invention, a contact retainer having stop surfaces is provided, wherein one of the stop surfaces if formed by a hook shaped flange. The contact retainer retains a contact to a housing. The contact retainer stop surfaces cooperate with stop surfaces on the housing and on the contact to hold the contact to the housing. The hook shaped flange has a free edge facing an end of the contact retainer.

In accordance with another embodiment of the present invention, an electrical connector is provided comprising a housing, a contact and a contact retainer. The contact is located, at least partially, in the housing. The contact retainer connects the contact to the housing. The contact retainer comprises a longitudinal shell with a longitudinal slot extending between a front end and a rear end. The contact retainer has a flange projecting from the shell so that a section of the flange is generally parallel with a surface of the shell. The flange has a free edge facing an end of the shell. The surface of the shell has a first sheared step. The first sheared step forms a stop surface opposing the flange free edge. The first sheared step is located to entrap a portion of the housing between the flange free edge and the stop surface.

BRIEF DESCRIPTION OF THE DRAWINGS

FIG. 2 is a perspective view of a contact retainer shown in FIG. 1 used to hold the contact to the housing of the electrical connector; and FIG. 3 is a cross-sectional view of the contact retainer shown in FIG. 2 taken along line 3–3.

DETAILED DESCRIPTION OF THE PREFERRED EMBODIMENT

Figure 1:
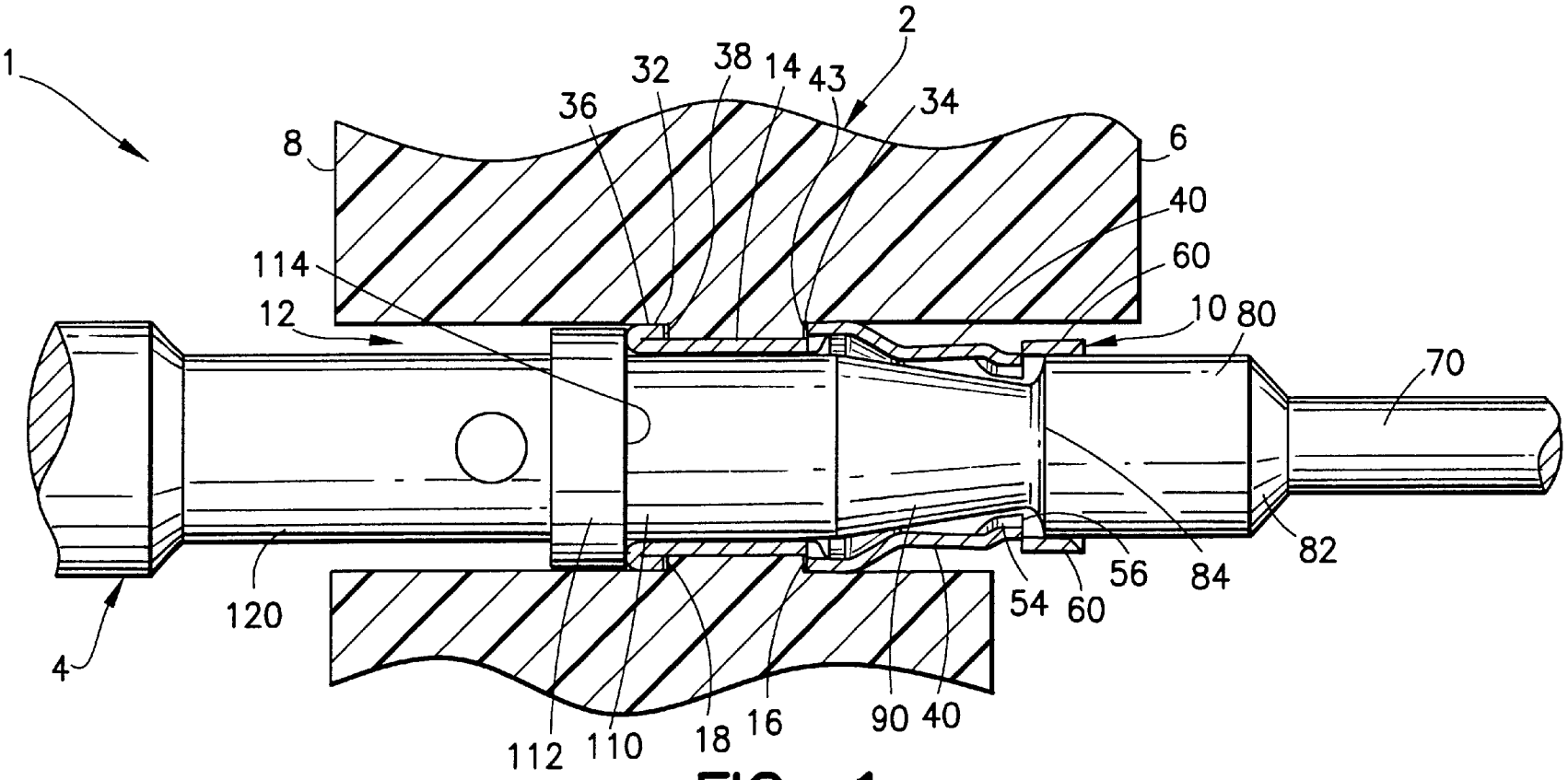
FIG. 1 is a cross-sectional view of an electrical connector incorporating features of the present invention.

Referring to FIG. 1, a cross-sectional side view of an electrical connector 1 is shown incorporating features of the present invention. Although the present invention will be described with reference to the single embodiment shown in the drawings, it should be understood that the present invention may be incorporated into various different types of contact retainers or electrical connectors. In addition, any suitable size, shape or type of elements or materials could be used.

The electrical connector 1 generally comprises a housing 2, an electrical contact 4 and a contact retainer 10. The contact retainer 10 is fixedly connected to the housing 2. The contact 4 is connected to the contact retainer 10. Thus, the contact retainer 10 holds the electrical contact 4 to the housing 2.

The connector housing 2 is preferably made of dielectric material, such as molded plastic or polymer material. The housing 2 has a front end 6, a rear end 8, and a contact receiving passageway or channel 12 therebetween. The passageway 12 has a restriction 14. The restriction 14 extends longitudinally along the passageway 12 between a front lip 16 and a rear lip 18. In the preferred embodiment, the passageway 12 has a circular cross-section. In alternate embodiments, the passageway may have any suitable shape for receiving a complementary electrical contact.

Referring also to FIGS. 2 and 3, the contact retainer 10 is preferably a one piece member made from flat sheet metal material that has been cut and formed into a generally tubular shell 20. The shape of the retainer 10 is adapted to fit within the passageway 12 in the housing 2. The shell 20 has a longitudinal slot 22 extending from its rear end 100 to its front end 102. The shell 20 includes a generally annular rear stabilizer section 28, a resiliently flexible section 30, a forward facing external stop 32, rearward facing external stops 34 and internal tabs 58. The resiliently flexible section 30 extends in a forward direction from the rear stabilizer section 28. The forward facing external stop 32 is located at the rear end 100 of the shell 20. The rearward facing stops 34 are located on the flexible section 30 at a front end of the stabilizer section 28. The internal tabs 58 are also located on the flexible section 30.

As seen in FIG. 1, when the contact retainer 10 is located in the passageway 12, the stabilizer section 28 generally contacts the surrounding surface of the restriction 14. The forward facing rear stop 32 comprises an external flange 36. The flange 36 is formed at the rear end 100 of the retainer 10 by bending the sheet metal material of the stabilizer section 28 about 180° into a general annular hook shape. This forms the flange 36 with a free edge 38 that faces the front end 102 of the contact retainer 10. The rear flange 36 projects above the stabilizer section 28 so that it generally compliments the profile of the restriction 14 in the passageway 12. The flange 36 generally circumferentially contacts the passageway 12. When the retainer 10 is installed in the housing 2, the free edge 38 abuts the rear lip 18 of the restriction 14. In the preferred embodiment, the flange 36 is a unitary section generally parallel with and surrounding the exterior of the stabilizer section 28. In an alternate embodiment, the flange may comprise multiple sections located around the perimeter of the stabilizer section. In another alternate embodiment, the rear flange need not be parallel with the exterior of the stabilizer section, such as if the angle of bend is less than 180°.

The resiliently flexible section 30 comprises four spring members 40 which are cantilevered in a forward direction from the stabilizer section 28. In alternate embodiments the number of cantilevered spring members may be more or less than four. The spring members 40 are formed by cutting partial longitudinal slots 42 into the sheet metal material of the contact retainer 10. In the embodiment shown, the longitudinal slots 42 extend partially into the stabilizer section 28 to increase the flexibility of the spring members 40. The rearward facing stops 34, on the flexible section 30, comprise external sheared step edges 43. In the preferred embodiment, each spring member 40 has one of the external step edges 43 formed thereon. In alternate embodiments, the number of external step edges on the flexible section may vary. The sheared step edges 43 face the rear end 100 of the contact retainer 10. The step edges 43 are located above the exterior of the stabilizer section 28 complementing the profile of the restriction 14 in the passageway 12. Thus, when the contact retainer 10 is inserted into the passageway 12, the step edges 43 abut the front lip 16 of the restriction 14. The step edges 43 are located sufficiently forward of the free edge 38 on the rear flange 36 to entrap the restriction 14 between the free edge 38 and the step edges 43. Each spring member 40 has an external ramp section 44 that is located in front of the sheared step edges 43. Each ramp section 44 extends circumferentially across the curved width of each spring member 40. Uniform flat tabs 46 join the step edges 43 to the corresponding ramp sections 44. Arced transition pieces 48, circumferentially adjacent the tabs 46, connect the ramp section 44 on each spring member 40 to the stabilizer section 28. The transition pieces 48 include outer surfaces 50 extending from the rear of the ramp sections 44 and uniform with the tabs 46. Shoulder sections 52 transition from the larger diameter of the outer surface 50 on the transition pieces 48 to the smaller diameter of the stabilizer section 28 as shown in FIG. 3. The interface 53 between the shoulder 52 and stabilizer section 28 is located just forward of the external step edge 43. In an alternate embodiment, a spring member may be provided with a ramp section having a width equivalent to that of the step edge. Sections of the spring member adjacent to such a ramp may extend uniform with the stabilizer section 28. In another alternate embodiment, the ramp section may terminate in the step edge. This would eliminate the uniform tab 46 in-between.

Each spring member 40 also has an inwardly projecting tab 58 located proximate the forward end 102 of the contact retainer 10. The tabs 58 have internal ramp surfaces 54 and step edges 56. The internal ramp surfaces 54 project inwards and terminate at the internal sheared step edges 56. The edges 56 face the front end 102. In the preferred embodiment, tabs 58 are formed by stamping the sheet metal material of the spring members 40. In alternate embodiments, the internal ramp surfaces 54 and step edges 56 may be formed by any other suitable shaping process. The internal step edges 56 are longitudinally located on the spring members 40 to engage corresponding mating surfaces on the contact 4 when the contact 4 is inserted into the retainer 10. Each spring member 40 also defines a restraining lip 60 located in front of its internal step edge 56.

Referring now to FIG. 1, the electrical contact 4 has a generally cylindrical shape. The contact 4 comprises a forebody 70, a front section 80, a mid-section 110 and a rear extension 120. The forebody 70 extends in a forward direction from the front section 80. The forebody 70 may have a male pin or female receptacle configuration with a smaller diameter than the front section 80. The front section 80 has a forward facing, conical cam surface 82 extending between the smaller diameter forebody 70 and the larger diameter of the front section 80. An annular shoulder 84 transitions between the rear of the front section 80 and a smaller diameter neck portion 90 connecting the front section 80 to the mid-section 110 of the contact 4. The diameter of the front section 80 is sized to pass through the stabilizer section 28, but otherwise allow the forward facing internal step edges 56 on the retainer 10 to engage the rear shoulder 84 of the front section 80. The mid-section 110 has a length generally equivalent to the length of stabilizer section 28 of the contact retainer 10. The diameter of the mid-section 110 is adapted to contact the surrounding surface of the stabilizer section 28 urging the stabilizer section 28 against the restriction 14 in the passageway 12. A raised collar 112 between the mid-section 110 and the rear extension 120 provides a forward facing stop surface 114. The collar 112 fits within the passageway 12, but projects radially above the midsection 110 so that the stop surface 114 abuts the rear end 100 of the contact retainer 10. The stop surface 114 on the collar 112 is located sufficiently to the rear of the shoulder 84 on the front section 80 to positionally captivate the retainer 10 on the contact 4 between the shoulder 84 and the stop surface 114.

The electrical connector 1 is assembled by first inserting the contact retainer 10 into the passageway 12 of the housing 2. The contact retainer 10 is inserted, front end 102 first, through the rear end 8 of the housing 2. During insertion, the external ramp sections 44 contact the rear lip 32 of the restriction 14. With further insertion, the spring members 40 are resiliently deflected inward. This allows the external step edges 43 and the transition pieces 48 to pass through the restriction 14. When the rolled shoulder 52 of the transition pieces 48 passes the front lip 16 of the restriction 14, the spring members 40 return to their undeflected position. As the shoulders 52 move across the front lip 16, the spring members 40 maintain contact between the shoulders 52 and the front lip 16, hence deflecting the tab 46. When the step edges 43 pass the front lip 16, the tab 46 snaps back to its undeflected position locating the step edges 43 in front of the lip 16. The longitudinal separation between the step edges 43 and the interface 53 (between shoulders 52 and stabilizer 28) ensures that the front lip 16 on the restriction 14 is not on the shoulders 52 when the step edges 43 engage the lip 16. Thus, the full profile of the external step edge 43 engages the lip 16. When the spring members 40 are undeflected, the full profile of the external step edge 43 engages the front lip 16 of the restriction 14. The insertion of the contact retainer 10 is stopped when the free edge 38 of the hook shaped flange 36 at rear of the stabilizer section 28 contacts the rear lip 18 of the restriction 14. At this point, the restriction 14 in the passageway 12 is captured between the external step edges 43 and the edge 38 of the rear flange 36. This fixedly connects the retainer 10 to the housing 2.

After the contact retainer 10 is inserted in the housing 2, the electrical contact 4 is inserted into the contact retainer 10. The contact 4 is inserted into the passageway 12 through the rear end 8 of the housing 2. During the insertion into the contact retainer 10, conical cam surface 82 on the contact 4 cooperates with the internal ramp surfaces 54 on the contact retainer 10 to outwardly deflect the spring members 40 of the retainer 10. After the shoulder 84 of the front section 80 passes the internal ramp surfaces 54, the spring members 40 move inwards until the restraining lips 60 contact the front section 80. When the restraining lips 60 contact the front section 80, the internal step edges 56 project behind the shoulder 84. In this position, the internal step edges 56 engage the shoulder 84 of the front section 80 preventing withdrawal of the contact 4 from the retainer 10 in a rearward direction. Forward movement of the contact 4 is stopped when the stop surface 114 on the contact 4 contacts the rear end 100 of the retainer 10. Thus, the contact retainer 10 axially restrains the contact 4 therein. Because the contact retainer 10 is constrained in the passageway 12, the contact retainer 10, thus, longitudinally holds the contact 4 within the housing 2.

With the electrical connector 1 assembled, the contact retainer 10 laterally supports and axially aligns the contact 4 in the passageway 12. The retainer 10 is supported by the circumferential contact between the stabilizer section 28 and the restriction 14. The retainer 10 is also axially aligned with the passageway 12 by the circumferential contact between the stabilizer section 28 and restriction 14, as well as the contact between outer surfaces 50 on the spring members 40 and the passageway 12. In turn, the retainer 10 stably supports the contact 4 by the circumferential contact between the mid-section 110 on the contact 4 and the stabilizer section 28 of the retainer 10. In the preferred embodiment, the front section 80 of the contact 4 is stably held by the restraining lips 60 on the spring members 40 of the retainer 10. In an alternate embodiment, the neck 90 of the contact 4 may be stably held by contact with the ramp tabs 58 on the spring members 40.

The stability of the contact 4 within the housing 6 and the alignment of the contact 4 with the passageway depends on the circumferential fit between the contact 4 and the retainer 10 and between the retainer 10 and the passageway 12. The inherent radial flexibility of the retainer 10, due to its open cross section, ensures that a close fit exists between the contact 4 and the retainer 10 and also between the retainer 10 and the passageway 12. More specifically, this radial flexibility allows the mid-section 110 on the contact 4 to expand the surrounding stabilizer section 28 urging it into circumferential contact with the restriction 14. If the stabilizer section 28 is formed with a diameter which otherwise does not circumferentially contact the restriction 14, insertion of the mid-section 110 of the contact 4 into the stabilizer section 28 expands the stabilizer section 28 bringing it into circumferential contact with the restriction 14. Thus, close circumferential contact between mating surfaces on the contact 4, the retainer 10 and the restriction 14 is achieved by providing the mid-section 110 on the contact 4 with a diameter sized to radialy accommodate only the sheet metal of the stabilizer 28 between the mid-section 110 and the restriction 14. This eliminates the need to maintain tight tolerances on the diameter of the contact retainer 10 which can be difficult to control in the manufacture of formed sheet metal parts such as the retainer 10.

It should be understood that the above description is merely illustrative of the invention. Various alternatives and modifications can be devised by those skilled in the art without departing from this invention. Accordingly, the present invention is intended to embrace all such alternatives, modifications and variances which fall within the scope of the appended claims.

What is claimed is:

1. An electrical connector comprising:

a housing;

a contact located, at least partially, in the housing; and a contact retainer connecting the contact to the housing, the contact retainer comprising a longitudinal shell with a longitudinal slot extending between a front end and a rear end and having a flange with a free distal end projecting from the shell so that a section of the flange is generally parallel with a surface of an inner section of the shell and an edge of the free distal end of the flange faces an end of the shell, wherein the surface of the inner section has a first sheared step, forming a stop surface opposing the edge and entrapping a portion of the housing between the edge of the free distal end of the flange and the stop surface; and wherein the contact retainer has a second sheared step on an opposite surface from the first sheared step that faces a stop surface on the contact.

2. An electrical connector as in claim 1, wherein the flange is one flange that generally surrounds the rear end of the shell.

3. An electrical connector as in claim 1, wherein the edge of the free distal end of the flange faces the front end of the contact retainer.

4. An electrical connector as in claim 1, wherein the shell further comprises a stabilizer section contacting surrounding surfaces of the housing so that the contact retainer is longitudinally supported in a housing passageway.

5. An electrical connector as in claim 4, wherein the shell further comprises a resiliently flexible section extending forward from the stabilizer section, the resiliently flexible section having a plurality of longitudinal slots defining a plurality of cantilevered spring members.

6. An electrical connector as in claim 5, wherein the spring members have exterior ramp surfaces cooperating with housing surfaces to compress the flexible section of the shell during insertion of the contact retainer into the housing.

7. An electrical connector as in claim 5, wherein the spring members have interior ramp surfaces cooperating with surfaces of the contact to expand the flexible section of the shell during insertion of the contact into the contact retainer.

8. An electrical connector as in claim 5, wherein the slots in the flexible section extend partially into the stabilizer section increasing the flexibility of the cantilevered spring members.

9. An electrical connector as in claim 5, wherein the first sheared step and a second sheared step are formed in at least one cantilevered spring member.

* * * * *